United States Patent [19]

Plewes et al.

[11] 4,304,600

[45] Dec. 8, 1981

[54] MANUFACTURE OF HIGH-STRENGTH METALLIC ARTICLES

[75] Inventors: John T. Plewes; Murray Robbins, both of Berkeley Heights; Raymond C. Stoffers, Newark, all of N.J.

[73] Assignee: Bell Telephone Laboratories, Incorporated, Murray Hill, N.J.

[21] Appl. No.: 90,416

[22] Filed: Nov. 1, 1979

[51] Int. Cl.[3] ..... B22F 3/00

[52] U.S. Cl. ..... 75/206; 75/211; 75/200; 75/247; 428/545

[58] Field of Search ..... 75/200, 211, 206, 247; 428/545

[56] References Cited

U.S. PATENT DOCUMENTS

| | | | |
|---|---|---|---|
| 3,143,789 | 8/1964 | Iler et al. | 75/211 |
| 3,184,835 | 5/1965 | Coxe et al. . | |
| 3,290,144 | 12/1966 | Iler et al. | 75/206 |
| 3,516,935 | 6/1970 | Monforte et al. . | |
| 3,685,134 | 8/1972 | Blue | 75/221 |
| 3,779,714 | 12/1973 | Nadkarni et al. | 75/211 |
| 3,922,180 | 11/1975 | Fuchs et al. . | |

FOREIGN PATENT DOCUMENTS

| | | |
|---|---|---|
| 1100993 | 9/1955 | France . |
| 127524 | 2/1950 | Sweden . |

OTHER PUBLICATIONS

"*The American Metal Co. Ltd.*" FHC Brand Copper pp. 92–100; 1957.

*Primary Examiner*—Brooks H. Hunt
*Attorney, Agent, or Firm*—Peter A. Businger

[57] ABSTRACT

In the interest of mechanical strength and hardness, metallic bodies desirably contain dispersed particles whose diameter preferably is in the range of 50–10,000 Angstrom. A disclosed method for producing such metallic bodies calls for preparing a solution of mixed salts of elements, removing the solvent, transforming to metallic form, and compacting under pressure. Strength of a resulting metallic body may be further developed by aging and, optionally, cold deformation prior to aging.

Use of the disclosed method is indicated especially to produce bodies comprising immiscible elements. For example, when Mo is dispersed in Cu, high strength and electrical conductivity are realized.

12 Claims, No Drawings

MANUFACTURE OF HIGH-STRENGTH METALLIC ARTICLES

TECHNICAL FIELD

The invention is concerned with high-strength metallic articles and their fabrication.

BACKGROUND OF THE INVENTION

Certain elemental metals may have desirable properties such as, e.g., high conductivity or corrosion resistance and yet be deficient in other respects such as, e.g., tensile strength, hardness, or abrasion resistance.

Pure copper, for example, its excellent conductivity notwithstanding, may be unsuitable for certain electrical applications due to its relatively low tensile strength and hardness. In particular, pure copper may not be suited as an electrical wire material in situations where substantial lengths of wire are pulled through ducts in the course of installation. Similarly, pure gold has excellent corrosion resistance but may be too soft to serve as a contact material in heavy duty mechanical contact applications. In view of such and similar applications, means are desired for fabricating high-strength metallic articles.

According to one line of development, alloys such as, e.g., Cu alloys having high conductivity, strength, and hardness are produced by internal oxidation of an easily oxidized solute additive. In particular, U.S. Pat. No. 3,184,835, "Process for Internally Oxidation-Hardening Alloys, and Alloys and Structures Made Therefrom", issued May 25, 1965 to Charles D. Coxe et al. discloses single phase Cu alloys containing beryllium oxide or aluminum oxide. Two-phase oxidation hardened alloys are disclosed in U.S. Pat. No. 3,922,180, "Method for Oxidation-Hardening Metal Alloy Compositions, and Compositions and Structures Therefrom", issued Nov. 25, 1975 to E. O. Fuchs et al. which discloses copper alloys containing zirconium or hafnium oxide.

Relevant in connection with the invention is a field of metallurgical technology known as powder metallurgy which broadly encompasses the molding of shaped metallic articles by methods involving compacting a powder. For example, powder metallurgical processing may involve compacting a metallic powder into a desired shape, followed by sintering, i.e., consolidating the shaped article by heat treatment. Alternatively, processing may call for compacting a metal precursor such as, e.g., a mixture of oxides, followed by reduction and sintering. Methods of this type are disclosed, e.g., in Swedish Pat. No. 127,524, "Process for the Production of Metal Parts and Semimanufactured Metal Parts from Reducible Powdered Metal Compounds by Compacting and Sintering", published Feb. 28, 1950 in the name of H. G. G. Zapf and French Pat. No. 1,100,993, "Improvements in the Preparation of Metal Alloys in Powder Form or in Compact Sintered Pieces", published Sept. 27, 1955 in the name of S. Medvedieff. The preparation of intimate mixtures in powdered form is facilitated by methods such as, e.g., freeze drying as disclosed in U.S. Pat. No. 3,516,935, "Compacted Body and Method of Formation", issued June 23, 1970 to Frank R. Monforte et al.

SUMMARY OF THE INVENTION

High-strength metallic articles are made from elemental constituents, and are characterized in that particles of a second element having a diameter in a preferred range of 50–10,000 Angstrom are dispersed in a first element. Articles of the invention are made by a method comprising co-precipitation of mixed salts out of a solution followed by removal of the solvent to produce a residue comprising a mixture of salts, transforming into a mixture of metals and compacting under pressure at relatively low temperatures. Articles may be shaped as compacted or as further processed after compacting; for example, final shape may be obtained by cold drawing into rod or wire stock.

Among exemplary articles are Cu-Mo, Cu-W, and Cu-Mo-W metallic bodies which, on account of high strength and conductivity, are particularly suited for electrical applications. Achieved levels of tensile strength and electrical conductivity are, respectively, in excess of 60 Kpsi and in excess of 80 percent of the electrical conductivity of copper.

DETAILED DESCRIPTION

Metallic bodies having high strength are made by combining elemental constituents so as to produce a dispersion of one element in another. In the interest of achieving high strength without undue interference with electrical properties, particle diameter of the dispersed element is preferably in the range of 50–10,000 Angstrom. Examplary alloys are Cu-Mo, Cu-W, and Cu-Mo-W alloys in which dispersed Mo and W particles preferably have a diameter in the range of approximately 100–1,000 Angstrom.

An elemplary procedure for producing a Cu-Mo metallic body is as follows. A hydrous solution is prepared containing copper acetate and ammonium molybdate. Solvent is removed by spray drying, i.e., by spraying the solution into a flow of air which is heated to a temperature in excess of 100 degrees C. but typically not exceeding 200 degrees C. As a result of drying, an essentially homogeneous chemical mixture of salts precipitates in the form of a powder. The mixture of salts is decomposed at a temperature not exceeding approximately 1080 degrees (corresponding to the melting point of Cu) and preferably not exceeding 600 degrees C., higher temperatures preferably being avoided in the interest of limiting mobility of Mo or W. In the interest of adequate rate of reaction, decomposition temperature is preferably at least 240 degrees C.

The resulting chemical mixture of oxides is reduced in a reducing atmosphere to a mixture of elemental Cu and Mo; a hydrogen atmosphere is effective for this purpose. In the interest of limiting particle size, temperature during reduction is preferably kept low and, specifically, not exceeding a temperature of approximately 1080 degrees C., and preferably not exceeding 600 degrees C. If further processing of the resulting powder is in air, or, more generally, an atmosphere comprising at least 5 percent partial pressure oxygen, reduction temperature is preferably at least 400 degrees C. in the interest of preventing reoxidation upon exposure to such atmosphere. However, lower temperatures may be preferred when subsequent processing is in a vacuum or in an inert atmosphere such as, e.g., a nitrogen atmosphere.

The resulting Cu-Mo powder is compacted, e.g., by means of a hydraulic press to produce a body of the desired alloy. Compacting as well as all subsequent processing as may be desired, e.g., for shaping into a desired form, is carried out at temperatures sufficiently low and for times sufficiently short to minimize aggregation of Mo in the alloy. Temperatures as high as approximately 900 degrees C. may be used for sufficiently short time periods such as, e.g., a few minutes. In the interest of high density and strength of a shaped article, compacting temperature is preferably at least 700 degrees C.

Optional shaping after compacting such as, e.g., by cold deformation may be motivated further in the interest of increased strength and hardness of the alloy. Similarly, aging subsequent to compacting and, possibly, in combination with cold deformation may also be used to enhance alloy strength. Aging temperatures are preferably in a range of 400–650 degrees C.

An analogous procedure may be followed for producing an Cu-W metallic body starting from an aqueous solution of copper acetate and ammonium tungstate. Moreover, the described procedure may be varied in a number of respects such as, e.g., by replacing spray drying with freeze drying to remove solvent water. Spray drying and freeze drying are considered equally suitable in the interest of producing a powder of spheroidal particles having uniform size as is advantageous for uniform filling of a mold used for compacting under pressure.

Among other variations of the disclosed method are, e.g., the use of copper carbonate or copper citrate, copper propionate, or other organic copper salt instead of copper acetate. In general, organic metal ligands are preferred due to their relatively low dissociation temperatures in a preferred range of 200 to 600 degrees C. This is in contrast to high dissociation temperatures of inorganic salts such as, e.g., copper sulfate which in the absence of sufficient oxygen and at low temperatures tends to decompose into copper sulfide rather than copper oxide, thereby causing inclusion of residual sulfur in the alloy. Similarly, the use of phosphates of metals is considered undesirable in view of their high dissociation temperatures and in view of a detrimental influence on electrical conductivity of residual phosphorus.

Instead of ammonium molybdate or tungstate, other water soluble Mo- or W- containing salts may be used. Solutions such as, e.g., $MoO_3$ or $MoO_5$ in methanol or $MoCl_2$ or $MoCl_5$ in hydrochloric acid may also be employed.

According to the described method, metallic bodies may be produced containing copper on the one hand and molybdenum and/or tungsten on the other in any desired proportion. However, in the interest of realizing adequate electrical conductivity, presence of Mo and W, in combination, preferably does not exceed 10 weight percent. More specifically, in the interest of realizing conductivity of at least 80 percent of the conductivity of copper, such presence preferably does not exceed 1 weight percent. Also, in the interest of appreciable strengthening, Mo and/or W should preferably be present in a combined amount of at least 0.1 weight percent. To achieve desired levels of strength such as, in particular, tensile strength of at least 60 Kpsi, Mo and/or W preferably constitute at least 0.3 weight percent.

Inclusion of elements other than Cu and Mo or W is preferably minimized in the interest of maximizing conductivity. However, where lower values of conductivity are acceptable, the use of additives to develop specific desired properties is not precluded. Influence of various additives on the properties of copper are disclosed in the book, OFHC Brand Copper, published by the American Metal Company, Limited, 1957, which specifically mentions elements Bi, C, Cr, Fe, Mn, Ni, O, P, Ag, S, and Te.

While in the case of copper described above, high conductivity is an important consideration, metallic articles may be produced with different objectives. For example, Ag—Mo, Au—Mo, Ag—W, Au—W, Ag—Mo—W, and Au—Mo—W may be of interest as contact materials due to their high corrosion resistance. Such articles may be produced starting with solutions of appropriate salts such as, e.g., propionates or acetates and proceeding as described above.

The described method may be adapted for producing metallic articles comprising any two elements which, at least in part, are thermodynamically immiscible at a desired temperature and pressure. Starting from a solution of salts, a residue comprising a mixture of salts is obtained by removal of solvent. The mixture of salts is transformed into a mixture of metals, either by direct reduction or, as in the case described above, by decomposition followed by reduction. Upon compacting, a strengthened metallic body is obtained.

The disclosed method is of particular commercial interest for the manufacture of metallic bodies comprising elements which are immiscible in a liquid state, i.e., in instances where melt practice is ineffective.

EXAMPLE 1.

312.3 gm Cu acetate, $Cu(C_2H_3O_2)_2.H_20$, and 0.8 gm ammonium molybdate, $(NH_4)_6Mo_7O_{24}.4H_2O$, were dissolved in excess water. A mixture of salts was obtained from the solution by spray drying, the mixture was decomposed by heating for 5 hours at a temperature of 500 degrees C. to produce a mixture of oxides, and the oxides were reduced by heating for 4 hours at a temperature of 500 degrees C. in a hydrogen atmosphere. Composition of the resulting metallic powder was 99.6 weight percent Cu and 0.4 weight percent Mo.

The powder was encapsulated in a stainless steel jacket, hot rolled at a pressure of 40 Kpsi and a temperature of 850 degrees C. (resulting in a 50 percent area reduction), and water quenched. After removal of the jacket, the pressed Cu-Mo body was swaged round and drawn so as to result in 80 percent area reduction and a final diameter of 0.056 in.

Tensile strength and conductivity were determined, respectively, to be 62 Kpsi and 92.8 percent of the conductivity of copper.

EXAMPLE 2.

176.2 gm copper carbonate, $CuCo_3$, and 0.8 gm ammonium molybdate, $(NH_4)_6Mo_7O_{24}.4H_2O$, were dissolved in excess ammonium oxalate, $(NH_4)_2C_2O_4.H_2O$. Ammonium hydroxide, $NH_4OH$, was added to render the solution basic (pH greater than 7) and the solution was spray dried. Further processing and final properties were as described in Example 1 above.

EXAMPLE 3.

A sample having a diameter of 0.056 in. was produced by the method described in Example 1 above and further processed as follows. The sample was heated for 45 minutes at a temperature of 550 degrees C. to cause controlled coarsening of Mo dispersion, and the heat treated sample was drawn to a diameter of 0.035 in.

Measured properties were a tensile strength of 68 Kpsi and a conductivity of 95 percent of that copper.

EXAMPLE 4.

A sample was processed as described in Example 3 above except that final drawing was to a diameter of 0.025 in. Measured properties were a tensile strength of 72 Kpsi and a conductivity of 95 percent of that of copper.

EXAMPLE 5.

328.0 gm Cu propionate, $Cu(C_3H_5O_2)_2$, and 1.1 gm ammonium molybdate, $(NH_4)_6Mo_7O_{24}.4H_2O$, were dissolved in excess water. A mixture of salts was obtained from the solution by spray drying, the mixture was decomposed by heating for 5 hours at a temperature of 450 degrees C. to produce a mixture of oxides, and the oxides were reduced by heating for 4 hours at a temperature of 400 degrees C. in a hydrogen atmosphere. Composition of the resulting metallic powder was 99.4 weight percent Cu and 0.6 weight percent Mo.

The powder was encapsulated in a stainless steel jacket, hot rolled at a pressure of 40 Kpsi and a temperature of 700 degrees C. (resulting in 50 percent area reduction), and water quenched. After removal of the steel jacket, the pressed Cu-Mo body was swaged round and drawn so as to result in 50 percent area reduction and a diameter of 0.050 in. The drawn sample was heated at 500 degrees C. for 1 hour and then drawn to result in an additional 75 percent area reduction.

Properties were a tensile strength of 62 Kpsi and a conductivity of 92 percent of the conductivity of copper.

EXAMPLE 6.

312.3 gm Cu acetate, $Cu(C_2H_3O_2)_2.H_2O$, and 0.85 gm ammonium tungstate, $(NH_4)_{10}W_{12}O_{41}.5H_2O$ are dissolved in excess water. Processing as described in Example 1 above yields a Cu-W alloy containing 0.6 weight percent W.

We claim:

1. Method for making a strengthened metallic body, said body consisting essentially of an alloy having a first component and a thermodynamically immiscible second component, said first component consisting of at least one first element selected from the group consisting of Cu, Ag, and Au, and said second component consisting of at least one second element selected from the group consisting of Mo and W, said method comprising the steps of (1) preparing a solution comprising mixed salts of said at least one first element and said at least one second element, (2) removing the solvent to produce a residue comprising a mixture of salts of said at least one first element and said at least one second element, (3) transforming, by heating, said mixture of salts into a mixture of metals, (4) consolidating said mixture of metals under pressure, resulting in a metallic body in which said second component has a particle size in the range of 50–10000 Angstroms, and (5) deforming said metallic body by an amount corresponding to an area reduction of at least 50 percent.

2. Method of claim 1 in which transforming said mixture of salts comprises a step of reducing by heating.

3. Method of claim 2 in which transforming said mixture of salts comprises a step of decomposing by heating.

4. Method of clam 1 in which said first component is essentially Cu, in which transforming said mixture of salts is by heating at temperatures not exceeding 1080 degrees C., and in which consolidating is at temperatures not exceeding 900 degrees C.

5. Method of claim 4 in which said mixture of salts is transformed at temperatures not exceeding 600 degrees C.

6. Method of claim 4 in which said body, after deforming, is heat treated at temperatures in the range of 400–650 degrees C.

7. Method of claim 4 in which said mixture of salts is transformed by decomposing and reducing, reducing being by heating at temperatures of at least 400 degrees C.

8. Method of claim 1 in which at least one of said salts is an organic salt.

9. Method of claim 1 in which said second component is present in said body in an amount corresponding to at least 0.1 percent.

10. Method of claim 1 in which said second component is present in said body in an amount of at most 10 weight percent.

11. Method of claim 1 in which said first component is essentially copper and in which said body has an electrical conductivity of at least 80 percent of the electrical conductivity of copper, and in which said second component is present in said body in an amount corresponding to at most 1 weight percent of said body.

12. Method of claim 11 in which said body has a tensile strength of at least 60 Kpsi and in which said second element is present in said body in an amount corresponding to at least 0.3 weight percent of said body.

* * * * *